US011339959B2

(12) United States Patent
Baker

(10) Patent No.: US 11,339,959 B2
(45) Date of Patent: May 24, 2022

(54) LIGHT EMITTER

(71) Applicant: Hubbell Lighting, Inc., Shelton, CT (US)

(72) Inventor: Derek Baker, Middleboro, MA (US)

(73) Assignee: Hubbell Lighting, Inc., Shelton, CT (US)

( * ) Notice: Subject to any disclaimer, the term of this patent is extended or adjusted under 35 U.S.C. 154(b) by 0 days.

(21) Appl. No.: 17/066,125

(22) Filed: Oct. 8, 2020

(65) Prior Publication Data

US 2021/0102693 A1 Apr. 8, 2021

Related U.S. Application Data

(60) Provisional application No. 62/912,383, filed on Oct. 8, 2019.

(51) Int. Cl.
*F21V 23/06* (2006.01)
*F21S 4/28* (2016.01)

(52) U.S. Cl.
CPC ..... *F21V 23/06* (2013.01); *F21S 4/28* (2016.01)

(58) Field of Classification Search
None
See application file for complete search history.

(56) References Cited

U.S. PATENT DOCUMENTS

| | | | |
|---|---|---|---|
| 2009/0290345 | A1 | 11/2009 | Shaner |
| 2010/0181890 | A1 | 7/2010 | Tseng et al. |
| 2011/0069493 | A1 | 3/2011 | Huang |
| 2012/0287634 | A1 | 11/2012 | Kochetkov |
| 2017/0292683 | A1 | 10/2017 | Kim et al. |

OTHER PUBLICATIONS

PCT/US2020/054789 International Search Report and Written Opinion dated Dec. 28, 2020.

*Primary Examiner* — Elmito Breval
(74) *Attorney, Agent, or Firm* — Michael Best & Friedrich LLP

(57) ABSTRACT

A light emitter includes a first portion, a light emitting element, a second portion, a pocket positioned in one of the first portion and the second portion, and an electrical connector. The first portion includes a first surface and a second surface opposite the first surface. The light emitting element is positioned adjacent the first surface of the first portion. The second portion is coupled to the second surface of first portion. The electrical connector is disposed in the pocket, and the electrical connector is recessed relative to the first surface of the first portion.

17 Claims, 10 Drawing Sheets

LIGHT EMITTER

REFERENCE TO RELATED APPLICATION

This application claims the benefit of prior-filed U.S. Provisional Patent Application No. 62/912,313, filed Oct. 8, 2019, the entire contents of which are incorporated by reference.

FIELD

The present disclosure relates to a light emitter, and more specifically to a substrate supporting a light emitting element and having a recessed feature for a connector.

SUMMARY

In one independent aspect, a light emitter includes a first portion, a light emitting element, a second portion, a pocket positioned in one of the first portion and the second portion, and an electrical connector. The first portion includes a first surface and a second surface opposite the first surface. The light emitting element is positioned adjacent the first surface of the first portion. The second portion is coupled to the second surface of first portion. The electrical connector is disposed in the pocket, and the electrical connector is recessed relative to the first surface of the first portion.

In some aspects, the electrical connector is coupled to the second surface of the first portion.

In some aspects, the first portion is electrically conductive, and the light emitting element and the electrical connector are in electrical communication through the first portion.

In some aspects, the connector is coupled to the second portion, and the second portion is electrically conductive.

In some aspects, at least one of the first portion and the second portion is formed as a plurality of layers, and each of the layers includes a cutout. The pocket is formed by the layers being stacked on one another such that the cutouts are aligned with one another.

In some aspects, the first portion is removably coupled to the second portion.

In some aspects, the pocket is a first pocket, and the light emitter further includes a second pocket positioned in the first portion, the second pocket configured to receive a fastener, the second aperture accommodating a head of the fastener and the head of the fastener is recessed relative to the first surface of the first portion.

In another independent aspect, a light emitter includes a first portion, a light emitting element, a second portion, a recess, and an electrical connector. The first portion includes a first surface and a second surface opposite the first surface. The light emitting element is positioned adjacent the first surface of the first portion. The second portion is adjacent the second surface of the first portion. The recess is positioned in the second portion. The electrical connector is coupled to the second surface and disposed in the recess, and the electrical connector is in electrical communication with the light emitting element.

In some aspects, the first portion is electrically conductive and provides electrical communication between the light emitting element and the electrical connector.

In some aspects, an area defined by the recess is larger than the electrical connector.

In some aspects, the second portion has a thickness that is larger than a thickness of the electrical connector.

In some aspects, the first portion includes a fastening aperture configured to receive a fastener.

In some aspects, the light emitter further includes a plug removably connected to the electrical connector, the plug providing electrical current to the light emitting element.

In some aspects, at least one of the first portion and the second portion is formed as a plurality of layers, and each of the layers includes a cutout. The pocket is formed by the layers being stacked on one another such that the cutouts are aligned with one another.

In some aspects, a thickness of the first portion between the first surface and the second surface is less than approximately 0.025 inches.

In yet another independent aspect, a light emitter includes a first portion, a light emitting element, a second portion, an aperture positioned in the first portion, and an electrical connector. The first portion includes a first surface and a second surface opposite the first surface. The light emitting element is positioned adjacent the first surface of the first portion. The second portion is coupled to the second surface of first portion. The electrical connector is disposed at least partially in the aperture and recessed relative to the first surface of the first portion. The electrical connector is supported on the second portion, and the electrical connector is in electrical communication with the light emitting element.

In some aspects, the first portion is formed as a plurality of layers, and each of the layers includes a cutout. A pocket is formed by the layers being stacked on one another such that the aperture is aligned with cutouts on other layers.

In some aspects, the first portion is removably coupled to the second portion.

In some aspects, the aperture is a first aperture, and the light emitter further includes a second aperture positioned in the first portion and configured to receive a fastener. The second aperture accommodates a head of the fastener and the head of the fastener is recessed relative to the first surface of the first portion.

In some aspects, the aperture at least partially forms a pocket, the pocket having a depth that is at least equal to a thickness of the electrical connector.

Other aspects of the disclosure will become apparent by consideration of the detailed description and accompanying drawings.

DETAILED DESCRIPTION

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical or hydraulic connections or couplings, whether direct or indirect. Terms of degree, such as "substantially," "about," "approximately," etc. are understood by those of ordinary skill to refer to reasonable ranges outside of the given value, for example, general tolerances associated with manufacturing, assembly, and use of the described embodiments.

Figure 1:
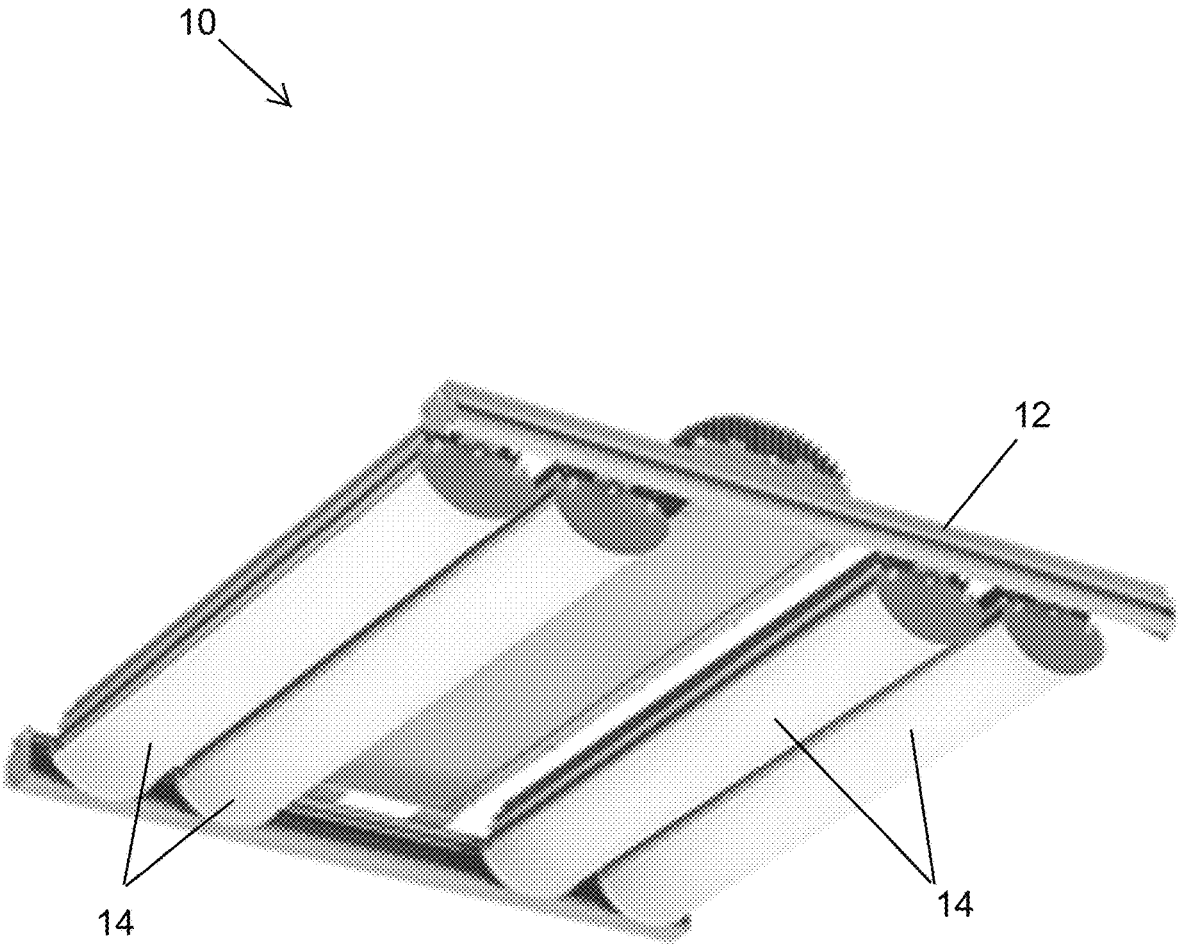
FIG. 1 is a perspective view of a luminaire.
Figure 2:
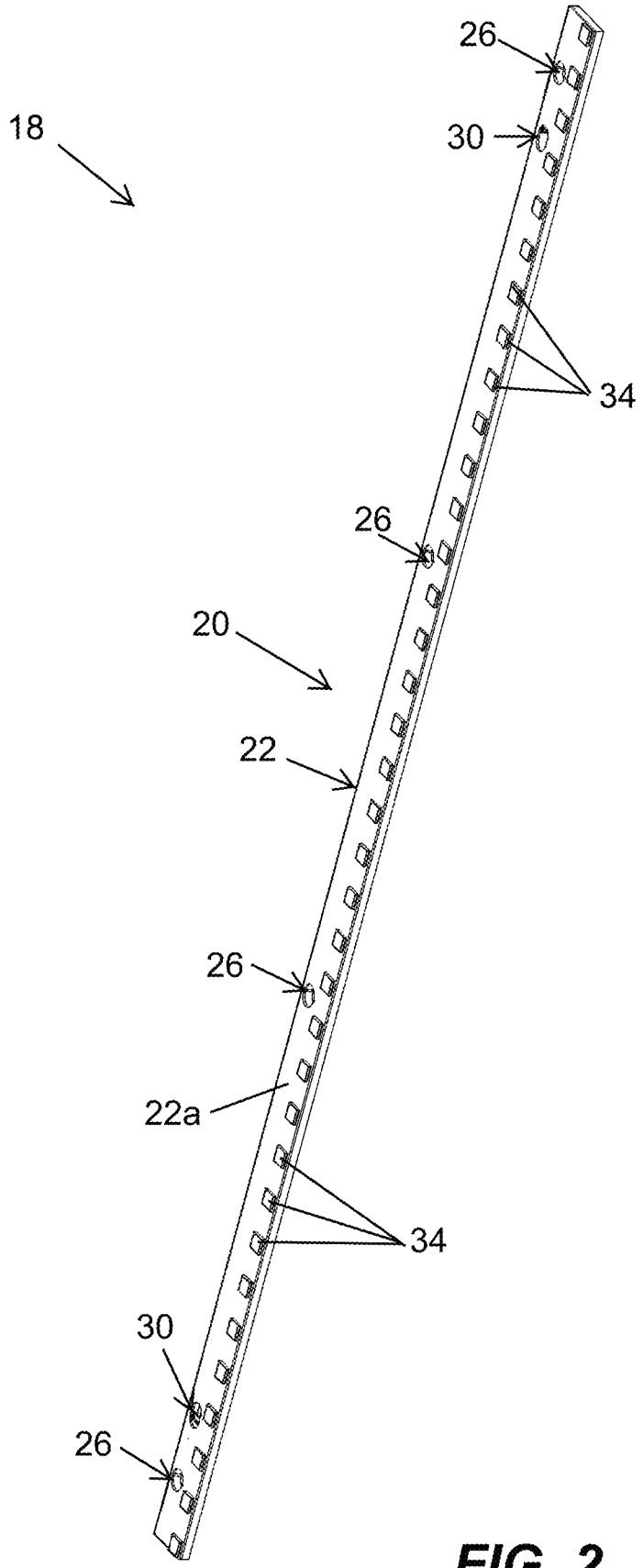
FIG. 2 is a perspective view of a light emitter.

As shown in FIG. 1, a luminaire 10 may be positioned on a support surface (e.g., on a ceiling) to provide illumination. The luminaire 10 includes a housing 12. In the illustrated embodiment, the luminaire 10 also includes an optic or lens 14 that is coupled to the housing 12 and directs light in a desired direction. The luminaire 10 includes one or more light emitters 18 (FIG. 2). Each light emitter 18 can be supported on the housing 12. The light emitter 18 is in communication with a power source (e.g., a driver—not shown) that provides electrical current to the light emitter 18.

Figure 5:
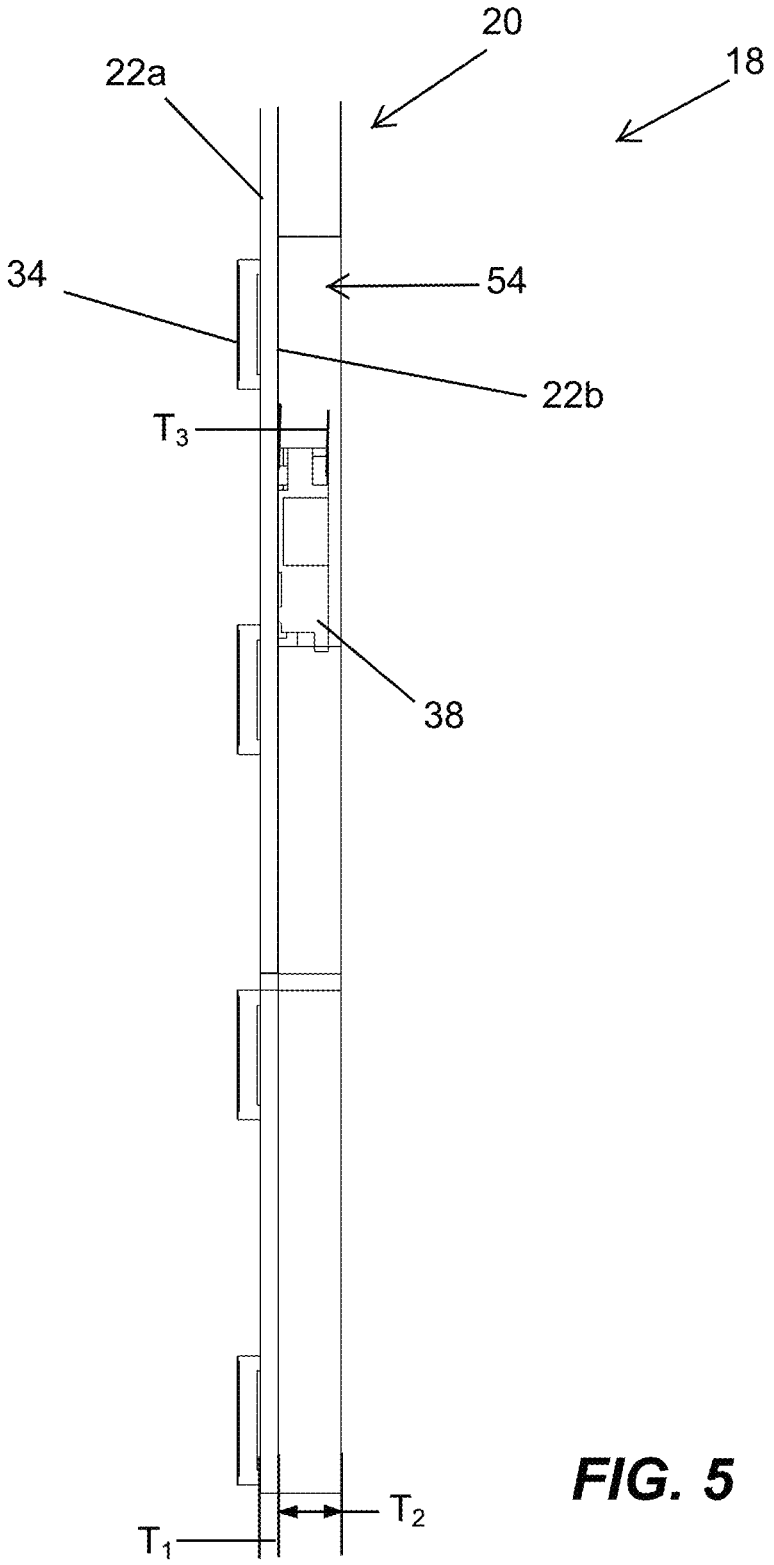
FIG. 5 is a side view pf the light emitter of FIG. 2.

As shown in FIG. 2, in the illustrated embodiment each light emitter 18 includes a substrate or board 20 (e.g., a printed circuit board (PCB)) formed as an elongated strip, and light emitting diodes or LEDs 34 are positioned on the board 20. The board 20 includes multiple layers, at least some of which are made from an electrically conductive material (e.g., copper). The conductive material permits electrical current to flow between a lower surface and an upper surface of the layer. The light emitter 18 includes a first or upper layer 22 having a first thickness T1 (FIG. 5). In some embodiments, the first thickness T1 is less than 0.1 inches. In some embodiments, the first thickness T1 is between 0.02 and 0.04 inches. In some embodiments, the first thickness T1 is 0.031 inches.

In addition, one or more apertures 26, 30 extend through the upper layer 22. The illustrated embodiment includes four first apertures 26 and two second apertures 30 extending through the top layer 22, although it is understood that other embodiments may include fewer or more apertures 26, 30. In the illustrated embodiment, the first apertures 26 are spaced apart from one another by a common distance and have a generally circular profile, while the second apertures 30 have an oblong profile.

Light emitting elements 34 (e.g., LEDs) are positioned along an upper surface 22*a* of the upper layer 22. In the illustrated embodiment, the LEDs 34 are aligned along one edge of the upper layer 22. In some embodiments, each LED 34 has substantially the same light emitting characteristics (e.g., color temperature).

Figure 3:
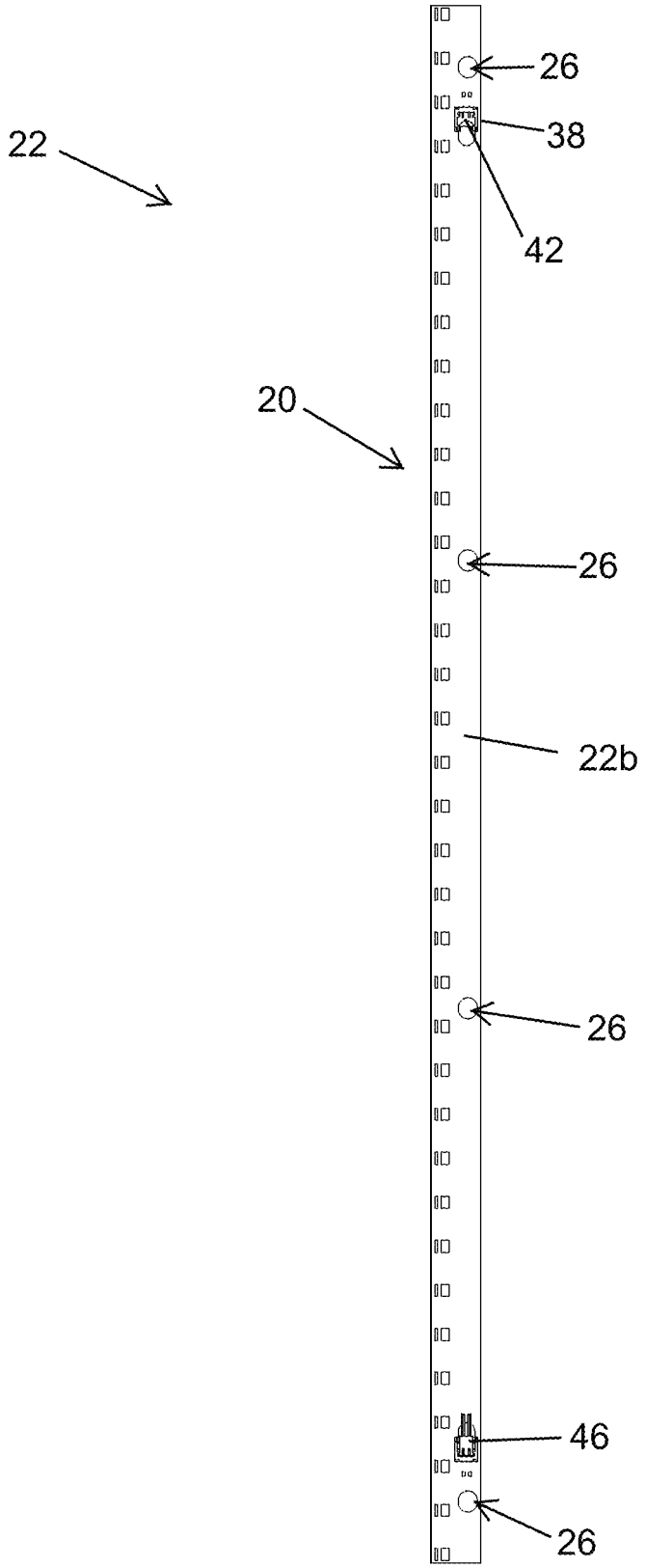
FIG. 3 is a bottom view of a first layer of the light emitter of FIG. 2.

As shown in FIG. 3, a lower surface 22*b* of the first layer 22 is positioned opposite the upper surface 22*a*. A connector 38 (e.g., an electrical connector) is positioned on the lower surface 22*b*, and is in electrical communication with the LEDs 34 positioned on the upper surface 22*a*. In some embodiments, the connector 38 permits current between 2.0-2.5 Amps, although other connectors may be used. In the illustrated embodiment, the connector 38 includes a receptacle 42 for receiving a plug 46. The plug 46 includes electrical wires and is configured to carry electrical current to the connector 38. The plug 46 can be in electrical communication with the driver and provide current to one of the connectors 38. A second plug 46 may connect to another connector 38 on the light emitter and electrically connect the illustrated light emitter 18 in series with another light emitter. In such a configuration, a common driver provides current for the interconnected light emitters 18.

In the illustrated embodiment, the connector 38 is soldered to the lower surface 22*b* proximate one of the second apertures 30. In other embodiments, the connector may be coupled to the lower surface 22*b* in another position and/or using other suitable means (e.g., glue, fasteners, etc.). Also, in other embodiments, the connector 38 may be a male connector configured to engage a female connector.

Figure 4:
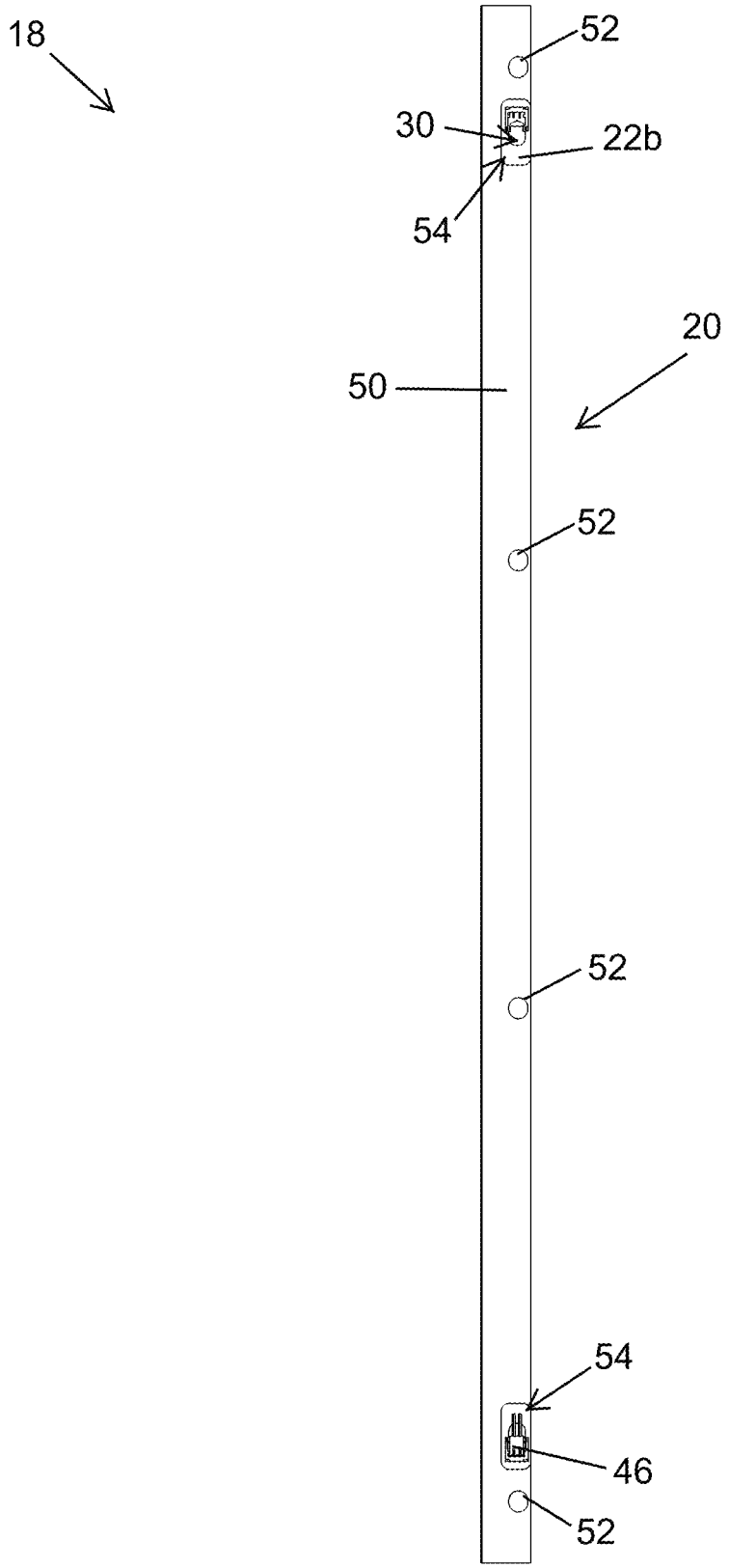
FIG. 4 is a bottom view of a second layer of the light emitter of FIG. 2.

As shown in FIGS. 4 and 5, an intermediate or second layer 50 is also coupled (e.g., by an adhesive) to the lower surface 22*b* of the upper layer 22. The second layer 50 includes third apertures 52 that are aligned with the first apertures 26. In addition, fasteners (e.g., threaded screws) extend through each of the respective first and third apertures 26, 52 to couple the light emitter 18 to the housing 12.

The second layer 50 also includes pockets or cutouts 54 aligned with the second apertures 30 of the upper layer 22. In the illustrated embodiment, each cutout 54 has a larger area than the respective second aperture 30 and extends through the second layer 50. The aligned cutouts 54 form a pocket. In the illustrated embodiment, the second layer 50 is made from an electrically insulated material to inhibit flow of electrical current through the layer 50. In other embodiments, the second layer 50 may be made from a material that is partially conductive (i.e., less conductive than the upper layer 22).

In some embodiments, the light emitter 18 includes multiple second layers 50 in a stacked relationship, and the upper layer 22 is positioned above the second layers 50. In the illustrated embodiment, each of the second layers 50 has substantially the same geometry. In addition, a lowermost layer 50*b* (FIG. 5) may form the base of the light emitter 18. Stated another way, the lowermost layer 50*b* and the upper layer 22 provide the lower and upper bounds of the light emitter 18.

Referring now to FIG. 5, in the illustrated embodiment the connector 38 has a thickness T3 and the second layer(s) 50 have a thickness T2 that is greater than the thickness T2 of the connector 38. The second layers 50 are substantially flat. In other embodiments, the thickness T2 of the second layers 50 may be equal to the thickness T3 of the connector 38 so that the connector 38 is flush with the uppermost and lowermost surfaces of second layers 50 and does not extend beyond the stack of second layers 50.

The connector 38 can be oriented in various ways to permit the plug 46 to be inserted into the receptacle 42 in a desired direction. For example, in some embodiments the plug 46 is insertable into the receptacle 42 in a vertical direction (e.g., from above the receptacle 42), while in other embodiments the plug 42 is insertable in a horizontal direction (e.g., along a longitudinal axis of the light emitter 18), in a transverse direction that is perpendicular to the longitudinal axis of the light emitter 18, or some combination of these directions. The pocket provided by the cutouts 54 provides clearance to permit insertion of the plug 46 and accommodate connected wires. In some embodiments, the plug 46 can extend through one of the second apertures 30.

Allowing the plug 46 to connect in multiple directions makes it easier for a user to connect and disconnect the plug 46 from the connector 38, particularly once the light emitter 18 is installed in the housing 12. In addition, the connector 38 is recessed within the pocket and does not protrude from a surface of the light emitter 18. As a result, the connector 38 does not interfere with mounting the light emitter 18 to the housing 12.

The light is emitted substantially unobstructed from the first layer 22 because the connectors 38 and the plugs 46 are recessed relative to the first layer 22. This reduces or eliminates shadowing (e.g., producing dark spots or other patterns because of interference) and increases the efficiency of the light emitted from the light emitter(s) 18.

Figure 6:
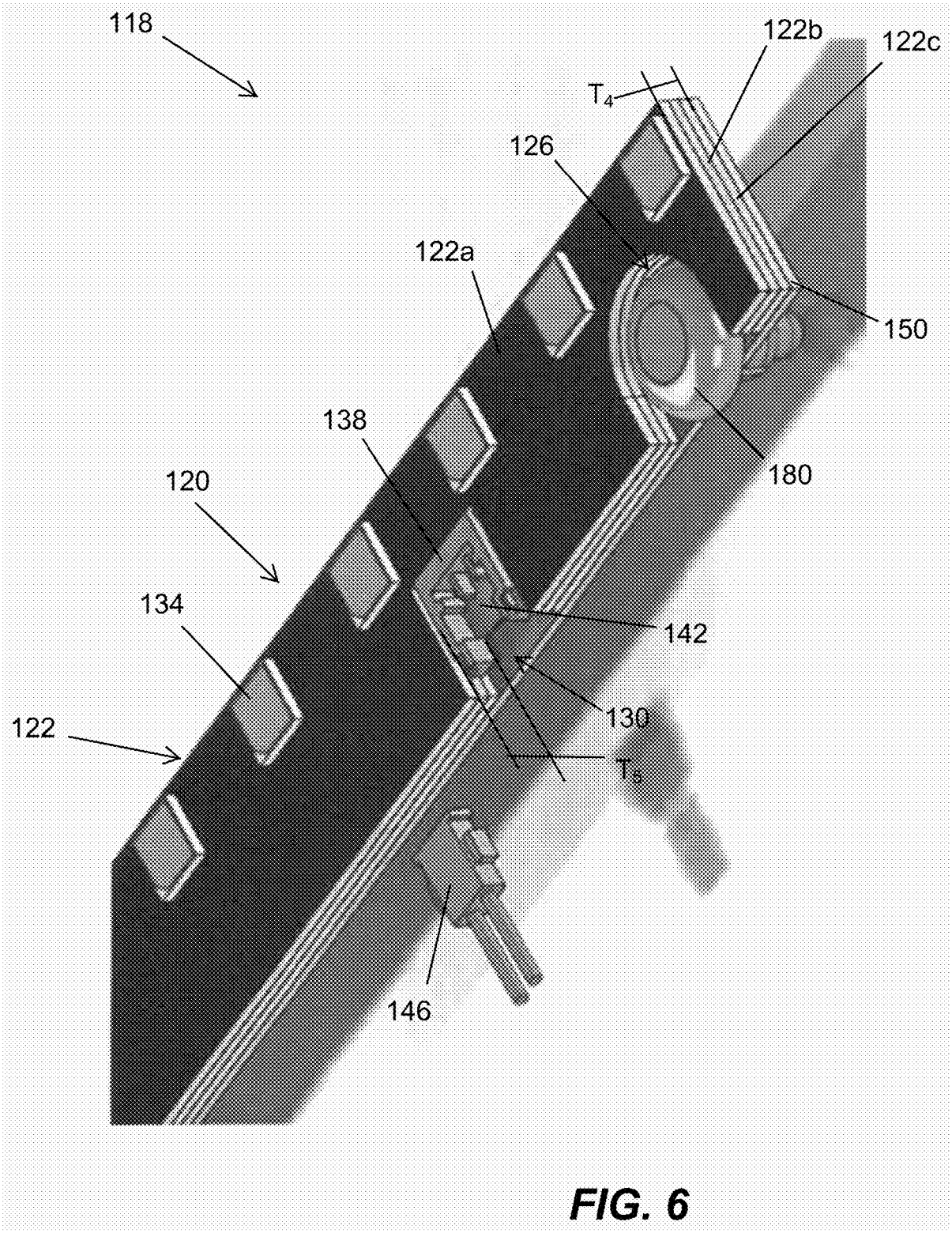
FIG. 6 is a perspective view of a light emitter according to another embodiment.
Figure 7:
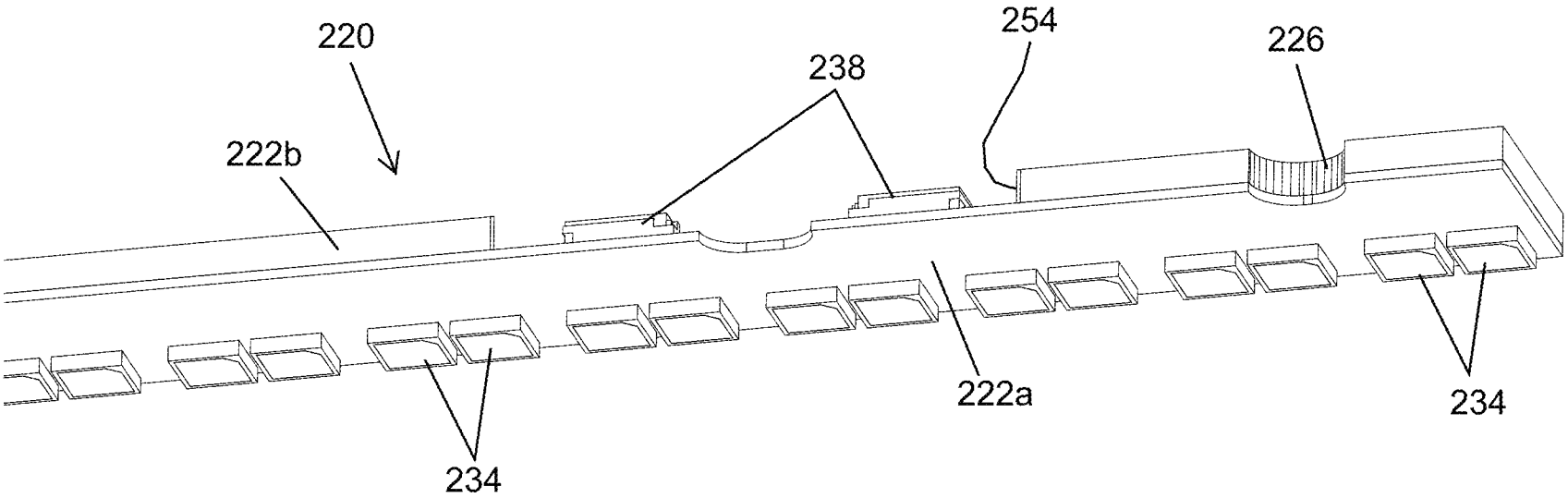
FIG. 7 is a perspective view of a light emitter according to yet another embodiment.

FIG. 6 illustrates a light emitter 118 according to another embodiment. Some similarities and differences between the light emitter 118 and the light emitter 18 are described herein, and similar features are identified with similar reference numbers, incremented by 100.

The light emitter 118 includes an upper portion 122 and a lower portion 150. The upper portion includes layers 122*a*, 122*b*, 122*c*, and the lower portion includes a second layer 150. Light emitting elements 134 (e.g., LEDs) are positioned on the uppermost layer 122*a*. In the illustrated embodiment, the LEDs 134 are aligned along an edge of the layer 122*a*. The upper portion 122 has a thickness T4. In some embodiments, T4 is less than 0.1 inches. In some embodiments, T4 is between 0.03 and 0.06 inches. In some embodiments, T4 is 0.047 inches. First apertures 126 and second apertures 130 extend through the layers 122*a*-122*c*. In the illustrated embodiment, the layers 122*a*, 122*b*, 122*c* are coupled together (e.g., via an adhesive). The second layer 150 is positioned adjacent the lowermost layer 122*c*. Each layer 122*a*-122*c* of the upper portion 122 is formed from an insulated material, and does not allow electrical current to flow through.

In the illustrated embodiment, a connector 138 is supported on the second layer 150 and positioned within a second aperture 130. The connector 138 has a thickness T5. In the illustrated embodiment, the thickness T5 is less than the thickness T4 and the connector 138 does not protrude above the first layer 122*a*. The connector 138 includes a receptacle 142 for receiving a plug 146. The plug 146 is configured to carry electrical current to the connector 138. Having the aperture 130 open through the uppermost layer 122*a* and through the side of the light emitter 118 permits the plug 146 to be coupled to the connector 138 without having to bend the wires, and facilitates easy connection/disconnection of the plug 146 after the light emitter 118 is assembled.

In the illustrated embodiment, the connector 138 is in electrical communication with the second layer 150, which in turn is in electrical communication with the LEDs 134 positioned on the first portion 122. For example, the connector 138 can be soldered to the second layer 150, or may be coupled to the second layer 150 using other suitable means. The second layer 150 is a PCB and is made from a conductive material (e.g., copper). Passageways (e.g., thermal vias—not shown) may extend through the layers 122*a*-122*c* and include a conductive material (e.g., solder). The conductive material is in contact with the second layer 150, permitting electrical current to flow from the connector 138 to the LEDs 134.

A fastener 180 (e.g., threaded screw) is positioned in the aperture 126. The fastener 180 extends through and engages the second layer 150 to couple the light emitter 118 to the housing 12. In the illustrated embodiment, a head of the fastener 180 does not protrude above the first portion 122. Since the connector 138 and the fastener 180 are recessed within the apertures 130, 126, the connector 138 and the fastener 180 do not interfere with mounting the light emitter 118 to the housing 12. In addition, the light emitted by LEDs 134 is substantially unobstructed because the fastener 180, connector 138, and plug 146 are recessed relative to the first portion 122. This reduces or eliminates shadowing and increases the efficiency of the light emitted from the light emitter 118.

In some embodiments, the upper portion 122 is removably coupled to the second layer 150 by a mechanical connection (e.g., by one or more pins—not shown), permitting the upper portion 122 to be removed from the second layer 150 after the light emitter 118 is coupled to the housing 12 (e.g., by fastener 180). Since the fastener 180 does not engage the upper portion 122 and the aperture 126 is larger than a diameter of the fastener 180, the upper portion 122 can be removed and replaced without having to remove the second layer 150 or the associated electrical connections. The luminaire 10 may be assembled with only the second layer 150 coupled to the housing 12. The upper portion 122 may then be coupled to the second layer 150 later (e.g., after the luminaire 10 is installed). Manufacturers may produce upper portions 122 that have different characteristics (e.g., different color temperatures, different intensities, different numbers of light emitting elements 134, etc.) that can be installed/replaced as needed as desired.

Optics (not shown) can be positioned adjacent the upper surface of the light emitters 18, 118. In some embodiments, a single optic is positioned over each light emitting element 34, 134 in order to provide a desired distribution pattern. Optics are positioned as close to the light emitting element 34, 134 as possible in order to produce the most efficient light emission possible (i.e., a maximum amount of light emitted through the optic in the desired direction). By positioning the connectors 38, 138 and fasteners 180 on a different surface (e.g., light emitter 18) or a different layer (e.g., light emitter 118) than the light emitting elements 34, 134, no protruding components will interfere with the placement of the optic(s). In other words, each optic can be fit directly around the light emitting elements 34, 134 because the uppermost layer 122 is substantially planar. Furthermore, it is not necessary to provide pockets in the optics (e.g., extra space around the light emitting elements 34, 134) that contribute to inefficiencies. Each optic may be substantially the same as the other optics on the board, simplifying manufacturing and assembly and reducing the number of unique parts. In some embodiments, each optic may be extruded using the same mold.

FIGS. 7-10 illustrate a light emitter 218 according to yet another embodiment. Some similarities and differences between the light emitter 218 and the light emitter 18 are described herein, and similar features are identified with similar reference numbers, incremented by 200.

In the illustrated embodiment, the light emitter 218 includes a board 220 including a first layer 222*a* and a second layer 222*b*. LEDs 234 are supported on a first side of the first layer 222*a*, and connectors 238 are positioned on a second, opposite side of the first layer 222*a*. Since both the LEDs 234 and the connectors 238 are connected to the first layer 222*a*, all of the circuitry and electrical connections between the LEDs 234 and connectors 238 can be positioned on or adjacent the first layer 222*a* without requiring electrical connections between multiple layers.

Figure 8:
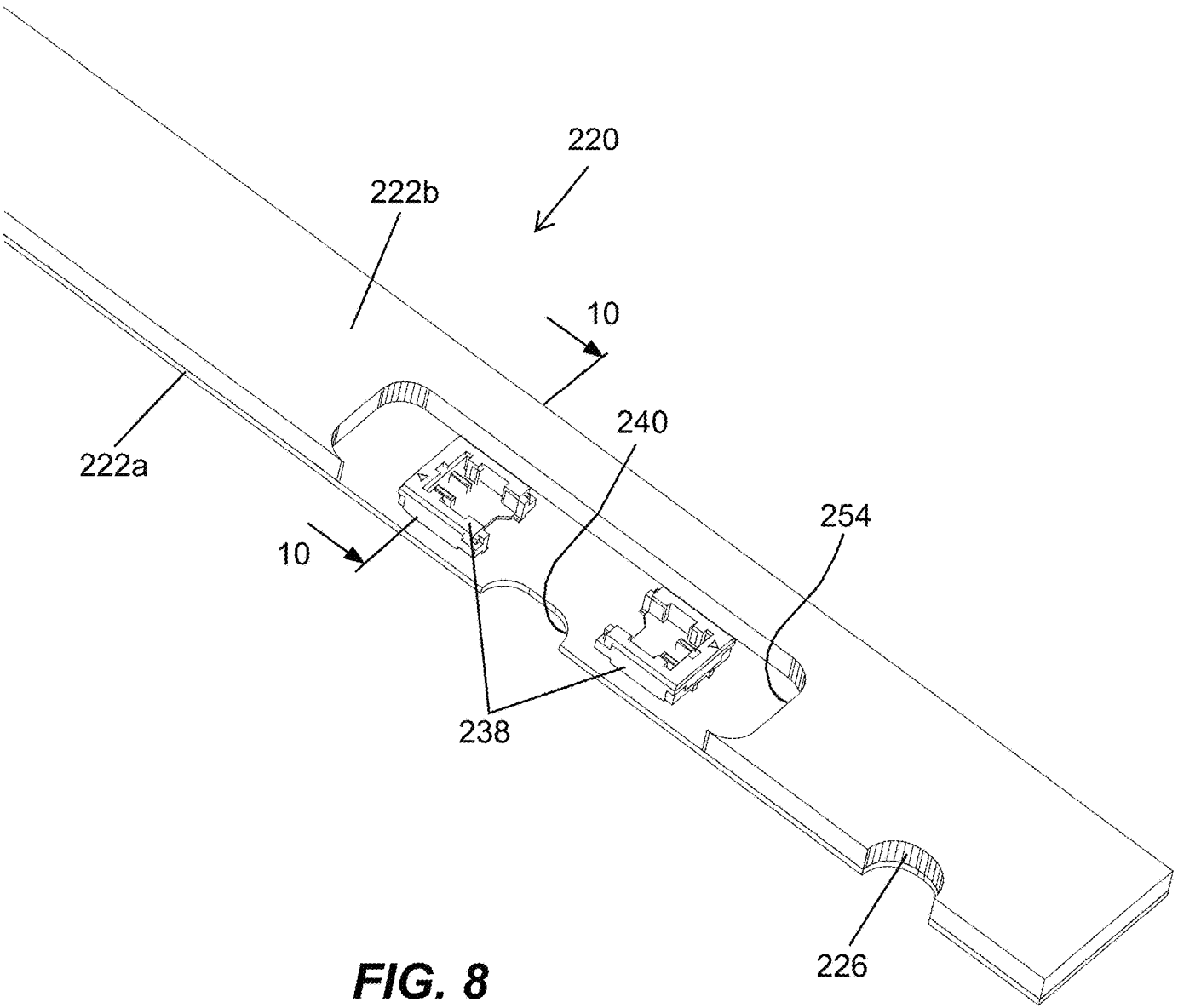
FIG. 8 is another perspective view of the light emitter of FIG. 7.
Figure 9:
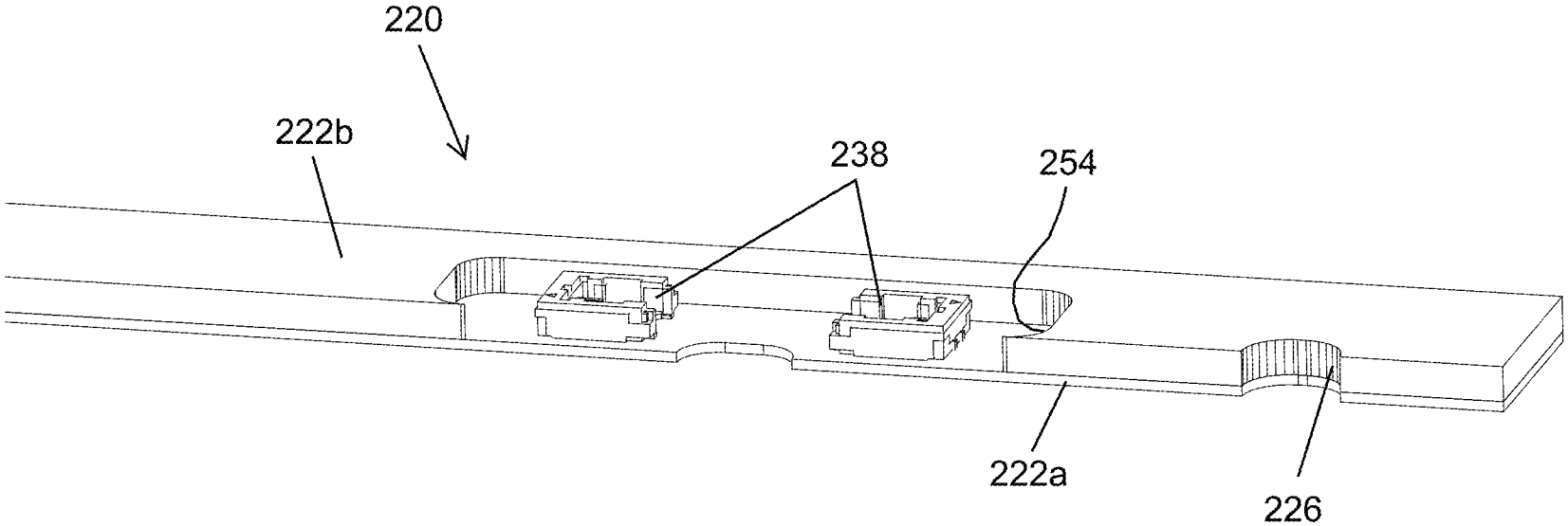
FIG. 9 is another perspective view of the light emitter of FIG. 7.
Figure 10:
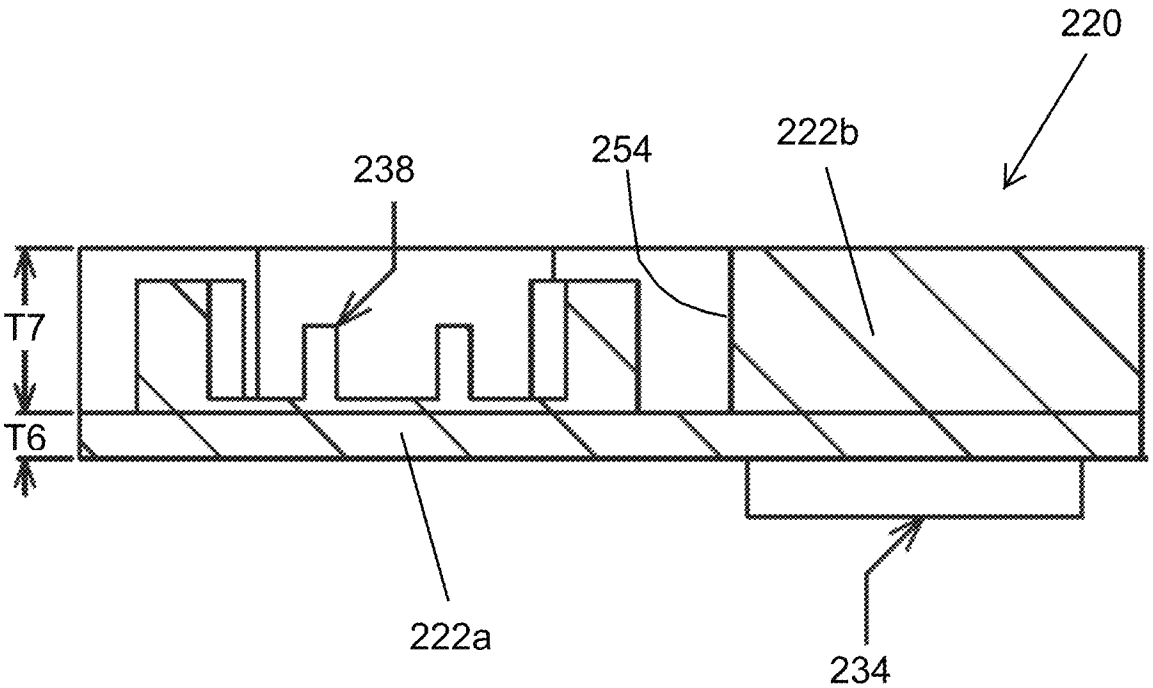
FIG. 10 is a section view of the light emitter of FIG. 7, viewed along section 10-10 of FIG. 8.

The spacer layer or second layer 222*b* provides additional thickness (e.g., to provide additional strength and/or rigidity to the board 220). The second layer 222*b* includes a pocket 254 (e.g., a cutout machined in the second layer 222*b*). As shown in FIGS. 8 and 9, in the illustrated embodiment, a pair of connectors 238 is positioned in one pocket 254. The connectors 238 may be oriented in opposite directions from one another. In the illustrated embodiment, a notch 240 (FIG. 8) is positioned in the first layer 222*a* and positioned between the pair of connectors 238.

In the illustrated embodiment, the first layer 222*a* has a thickness T6 that is between 0.005 inches and approximately 0.03 inches. In some embodiments, the thickness T6 is between approximately 0.01 inches and approximately 0.02 inches. In some embodiments, the thickness is approximately 0.016 inches.

In some embodiments, the second layer 222*b* has a thickness T7 that is similar to a thickness of the connector 234, or at least as thick as the connector 234. In some embodiments, the thickness T7 is between approximately 0.03 inches and approximately 0.07 inches. In some embodiments, the thickness T7 is between approximately 0.04 inches and approximately 0.065 inches. In some embodiments, the thickness T7 is between approximately 0.05 inches and approximately 0.06 inches. In some embodiments, the thickness T7 is approximately 0.058 inches.

The overall thickness of the board 220 may be comparable to conventional LED boards. In some embodiments, the overall thickness of the board 220 is between approximately 0.07 inches and approximately 0.08 inches. In some embodiments, the overall thickness of the board 220 is approximately 0.074 inches.

Although certain aspects have been described in detail with reference to certain preferred embodiments, variations and modifications exist within the scope and spirit of one or more independent aspects as described.

What is claimed is:

1. A light emitter comprising:

a first portion including a first surface and a second surface opposite the first surface;

a light emitting element positioned adjacent the first surface of the first portion;

a second portion coupled to the second surface of first portion;

a pocket positioned in one of the first portion and the second portion; and an electrical connector disposed in the pocket, the electrical connector recessed relative to the first surface of the first portion, wherein at least one of the first portion and the second portion is formed as a plurality of layers, each of the layers including a cutout, wherein the pocket is formed by the layers being stacked on one another such that the cutouts are aligned with one another.

2. The light emitter of claim 1, wherein the electrical connector is coupled to the second surface of the first portion.

3. The light emitter of claim 2, wherein the first portion is electrically conductive, and the light emitting element and the electrical connector are in electrical communication through the first portion.

4. The light emitter of claim 1, wherein the electrical connector is coupled to the second portion, the second portion being electrically conductive.

5. The light emitter of claim 1, wherein the first portion is removably coupled to the second portion.

6. The light emitter of claim 1, wherein the pocket is a first pocket, the light emitter further comprising a second pocket positioned in the first portion, the second pocket configured to receive a fastener, the second pocket accommodating a head of the fastener, the head of the fastener being recessed relative to the first surface of the first portion.

7. A light emitter comprising:

a first portion including a first surface and a second surface opposite the first surface;

a light emitting element positioned adjacent the first surface of the first portion;

a second portion adjacent the second surface of the first portion;

a recess positioned in the second portion; and an electrical connector coupled to the second surface and disposed in the recess, the electrical connector in electrical communication with the light emitting element, wherein at least one of the first portion and the second portion is formed as a plurality of layers, each of the layers including a cutout, wherein a pocket is formed by the layers being stacked on one another such that the cutouts are aligned with one another.

8. The light emitter of claim 7, wherein the first portion is electrically conductive and provides electrical communication between the light emitting element and the electrical connector.

9. The light emitter of claim 7, wherein an area defined by the recess is larger than the electrical connector.

10. The light emitter of claim 7, wherein the second portion has a thickness that is larger than a thickness of the electrical connector.

11. The light emitter of claim 7, wherein the first portion includes a fastening aperture configured to receive a fastener.

12. The light emitter of claim 7, further comprising a plug removably connected to the electrical connector, the plug providing electrical current to the light emitting element.

13. The light emitter of claim 7, wherein a thickness of the first portion between the first surface and the second surface is less than approximately 0.025 inches.

14. A light emitter comprising:

a first portion including a first surface and a second surface opposite the first surface;

a light emitting element positioned adjacent the first surface of the first portion;

a second portion coupled to the second surface of first portion;

an aperture positioned in the first portion; and an electrical connector disposed at least partially in the aperture and recessed relative to the first surface of the first portion, the electrical connector supported on the second portion, the electrical connector in electrical communication with the light emitting element, wherein the first portion is formed as a plurality of layers, each of the layers including a cutout, wherein a pocket is formed by the layers being stacked on one another such that the aperture is aligned with cutouts on other layers.

15. The light emitter of claim 14, wherein the first portion is removably coupled to the second portion.

16. The light emitter of claim 14, wherein the aperture is a first aperture, the light emitter further comprising a second aperture positioned in the first portion and configured to receive a fastener, the second aperture accommodating a head of the fastener, the head of the fastener being recessed relative to the first surface of the first portion.

17. The light emitter of claim 14, wherein the aperture at least partially forms a pocket, the pocket having a depth that is at least equal to a thickness of the electrical connector.

* * * * *